United States Patent [19]

Curinier et al.

[11] Patent Number: 4,510,657

[45] Date of Patent: Apr. 16, 1985

[54] ROTATING CREEL FOR A NONWOVEN FABRIC MACHINE

[75] Inventors: Jean Curinier; Philippe Pinet, both of Le Cheylard, France

[73] Assignee: Etablissements les Fils d'Auguste Chomarat & Cie, France

[21] Appl. No.: 448,328

[22] Filed: Dec. 9, 1982

[30] Foreign Application Priority Data

Dec. 23, 1981 [FR] France ..... 81 24346

[51] Int. Cl.[3] ..... D04H 3/00; B65H 49/00

[52] U.S. Cl. ..... 28/100; 156/439

[58] Field of Search ..... 242/131.1, 131; 156/439, 440; 28/100, 101

[56] References Cited

U.S. PATENT DOCUMENTS

| | | | |
|---|---|---|---|
| 3,755,034 | 8/1973 | Mahon et al. | 156/440 X |
| 3,801,401 | 4/1974 | Cope et al. | 156/439 X |
| 3,950,583 | 4/1976 | Patin | 156/439 X |
| 4,108,708 | 8/1978 | Gregory et al. | 28/101 X |
| 4,249,981 | 2/1981 | Pelletier et al. | 28/100 X |

FOREIGN PATENT DOCUMENTS

| | | |
|---|---|---|
| 1391900 | 2/1965 | France . |
| 2083433 | 12/1971 | France . |

*Primary Examiner*—Werner H. Schroeder
*Assistant Examiner*—Andrew M. Falik
*Attorney, Agent, or Firm*—Parkhurst & Oliff

[57] ABSTRACT

A yarn creel device in combination with apparatus for producing a textile web characterized by yarns extending cross-wise with respect to the length of the web is characterized by a plurality of feed bobbins fixedly mounted inside a plurality of rotating compartments by means of supporting cradles which are in turn mounted within the compartments for free rotation about the same axis of rotation as the compartments. As the compartments are driven in rotation, the supporting cradles are held immobilized by the weight of the bobbins. Yarn is distributed from the bobbins through a hollow axle and through spaces between consecutive compartments of the device.

3 Claims, 4 Drawing Figures

ROTATING CREEL FOR A NONWOVEN FABRIC MACHINE

BACKGROUND OF THE INVENTION

The present invention relates to an improved device for producing a web of yarns, in which the yarns extend crosswise with respect to the said web and are preferably parallel to one another.

Such a web is termed hereinafter "weft web", the yarns constituting it being termed "weft yarns".

Many devices are already known and used for producing weft webs designed to be associated with longitudinal parallel yarns, cohesion between the two being obtained for example by adhesive bonding, so as to form articles commonly known as "non-woven textile patterns". For other applications, these weft webs can be used for example as reinforcing elements in non-wovens used in the paper-making industry, and even as elements used in the manufacture of knitted articles produced according to the technique known as the "weft insertion by the front" technique, which consists of incorporating, over the whole width of the knitting produced on a warp knitting or Raschel machine, a weft thread in every row or every so many rows of stitches.

Many techniques have been proposed up to now to produce such weft webs. Amongst these should be mentioned the technique described in French Pat. No. 1 391 900 in which, when producing non-woven textile patterns, the weft web is produced with an assembly equipped with rotary elbow-shaped tubular wings which distribute the weft yarns around the two spaced out lateral elements, the reels supplying the yarn being placed in the same axis as the shaft driving the rotary wings in at least two axially adjoined compartments.

French Pat. No. 2 083 433 describes an improvement to the aforesaid technique wherein the feed bobbins are held in a stationary position inside the compartments for example by means of counterweights.

According to the said document, the compartments are constituted by tubular elements traversed by the yarns. Although such a solution provides for working with emergency bobbins, it nonetheless implies a complex assembly of said bobbins in the compartments, if they are to be held in a fixed position. Moreover, the yarns being guided inside tubular elements, said elements have a tendency to get clogged up with dirt and cause frictions on the yarns. And in addition, such an installation cannot be used with feed bobbins which are in the form of supportless rolls unrolled by the inside, which is often the case with glass yarns.

SUMMARY OF THE INVENTION

It is the object of the present invention to propose an improvement to the aforesaid installations and in particular to the assembly consisting of axially adjoined compartments placed upstream of the supply means actually depositing the yarns on spaced out parallel side elements such as for example sprocket conveyor belts, rotary spiral conveyors, etc.

The invention therefore relates generally to a device for producing a web constituted of yarns extending transversely with respect to the length of the web, which yarns are preferably parallel together, said device being of the type comprising:

means for supplying a plurality of weft yarns around two spaced out parallel side elements, creel means for storing yarn feed bobbins, constituted by a plurality of rotating compartments situated upstream of the supplying means, means wherein the feed bobbins are fixedly mounted inside the said compartments by means of supporting cradles mounted for free rotation about the same axis of rotation as the compartments, said cradles being immobilized by the actual weight of the feed bobbins.

Since according to the invention the feed bobbins are just placed inside the cradles, it is possible to have a supply either from textile yarn carriers unrolling from the outside or from textile carriers unrolling from the inside.

Moreover, such a device requires no special system to immobilize the feed bobbins, which considerably simplifies its utilization.

DESCRIPTION OF THE DRAWINGS

The invention will be more readily understood upon reading the following description with reference to the accompanying drawings in which.

DESCRIPTION OF THE PREFERRED EMBODIMENTS

According to one non-restrictive embodiment of the invention, the weft yarn creel feeding assembly comprises four adjoined compartments.

Figure 1:
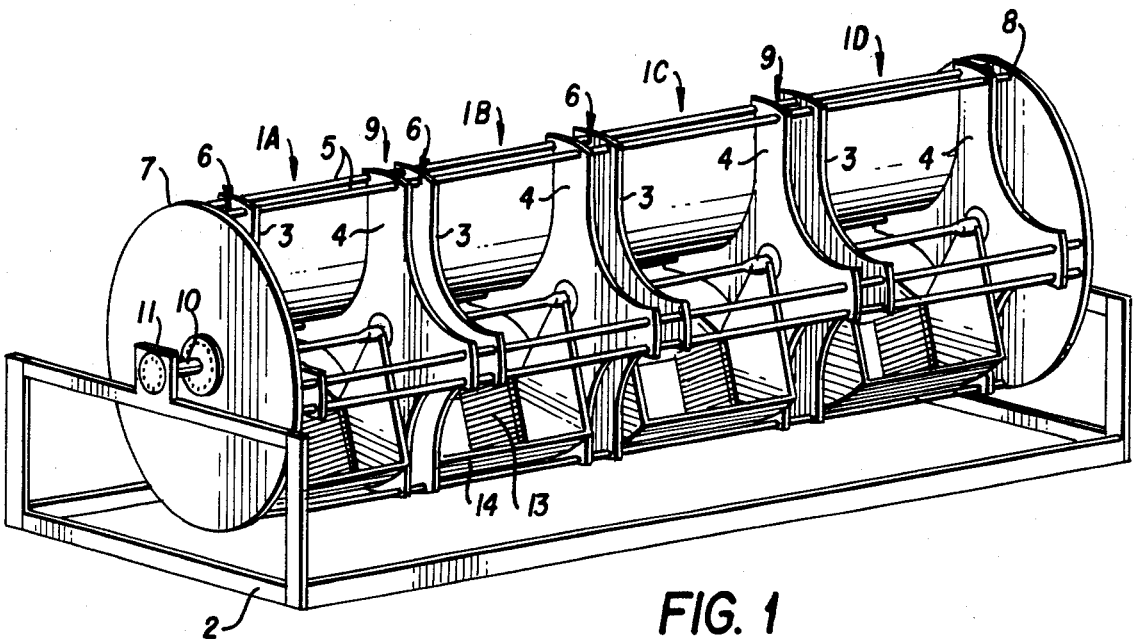
FIG. 1 is a perspective view of an assembly according to the invention permitting reception of the weft yarn feed bobbin and the bringing of said yarn to the distribution means. For simplification purposes, this assembly will be hereafter designated as storage and feeding assembly.
Figure 3:
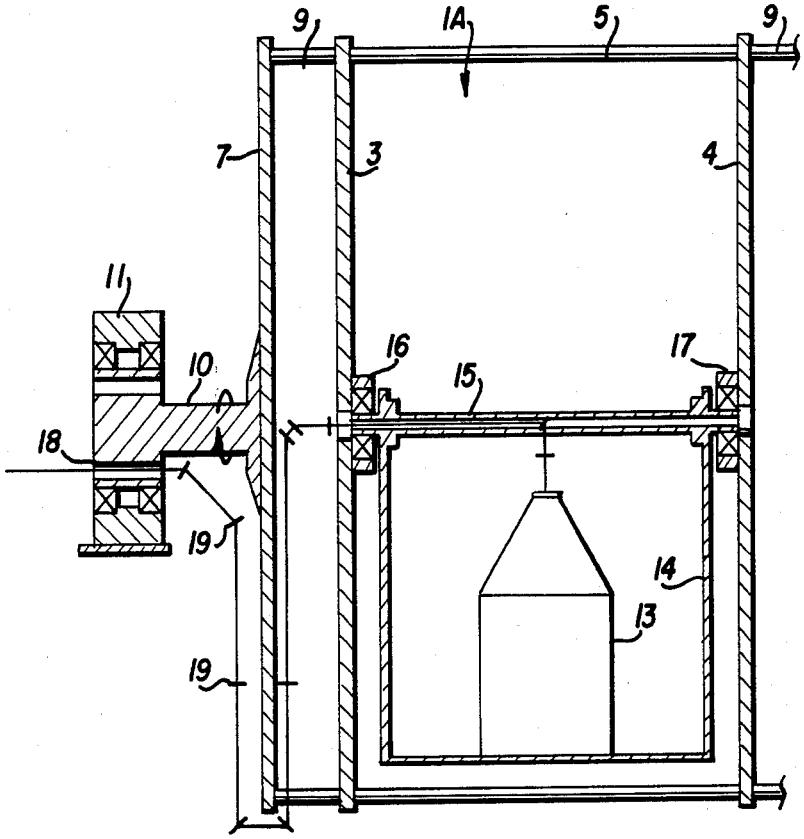
FIG. 3 is a cross-sectional view showing in greater detail the design of one of the compartments constituting said storage and feeding assembly, as well as the main path followed by the yarn.

Referring to FIGS. 1 and 3, the weft yarn creel assembly, according to the invention is constituted by four elementary compartments 1A, 1B, 1C, 1D mounted for rotation on a supporting frame 2.

Each of said compartments is constituted by two lateral plates 3, 4 preferably cross-shaped such as illustrated in FIG. 1 to give access to the inside. The space between the side plates 3, 4 will be determined in relation to the space required for housing the yarn feed bobbins. Said plates 3, 4 are interconnected by cross-pieces 5 designed to make the assembly rigid. Also according to the invention, a space 6 is provided between on the one hand, the end plates 7 and 8, and on the other hand, two consecutive compartments. Said space is defined by cross-pieces 9, and the rigid assembly so constituted is mounted for rotation on the frame 2 by means of intermediate shafts 10 mounted on bearings 11 provided on frame 2. Said assembly is driven in rotation by a motor 12 (see FIG. 2).

The yarn feed bobbins 13 are placed inside each compartment. To this effect, an assembly designated hereinafter as a supporting cradle 14 is mounted, as can be seen in FIG. 3, so that it can stay motionless when the compartments are driven in rotation. Bearings 16, 17 are provided for this purpose on the inner faces of the plates 3 and 4, said bearings supporting a hollow axle 15 holding the cradle in position.

Advantageously, two feed bobbins 13 are placed inside each compartment 1 (see FIG. 2) said bobbins immobilizing the cradle 14 by their own weight.

Figure 2:
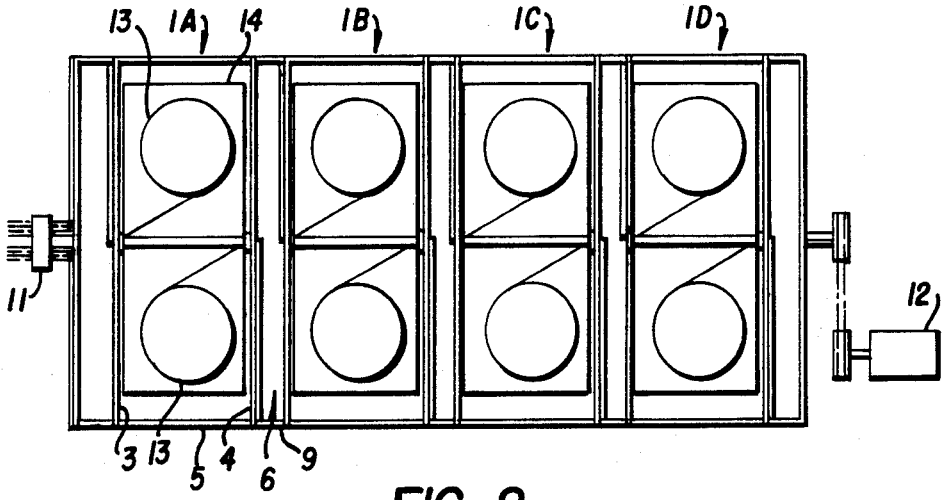
FIG. 2 is a view from beneath of the said storage and feeding assembly.

As clearly illustrated in FIGS. 2 and 3 the yarn to be distributed is fed through the internal conduit of axle 15 and into the space between two consecutive compartments, said yarns being brought to the distribution means through the conduits 18 provided in the supporting axle 10. Eyelets 19 are of course provided for guiding accurately the yarns on their path.

Whenever such an installation is used with two feed bobbins per compartment (see FIG. 2), one of the yarns will pass through the axle 15, emerging through the plate 3 whereas the other yarn will follow a reverse path through the axle 15, emerging into the space 6 situated at the back of the compartment.

Figure 4:
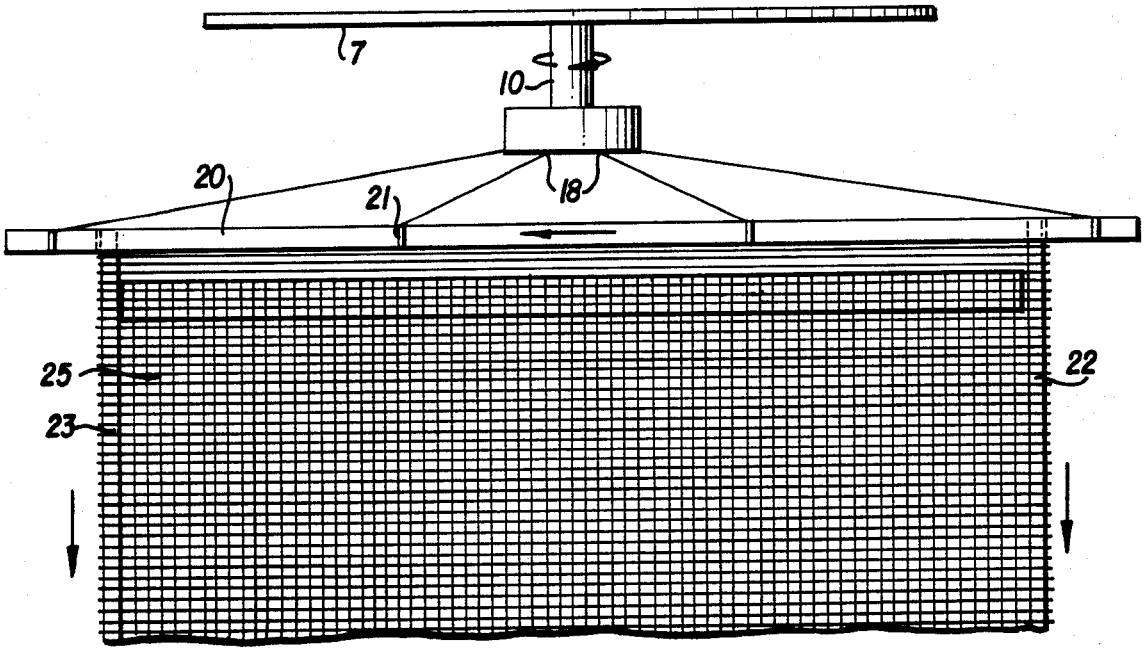
FIG. 4 is a view from beneath illustrating one embodiment of a non-woven textile pattern produced with an installation according to the invention.

Such a yarn storage and feeding assembly can be used for a large number of applications, for example to produce non-woven textile patterns such as that shown in FIG. 4.

To produce such patterns, distribution means 20 are used downstream of the compartment assembly, which means are formed in this particular example by a belt provided with yarn guides 21 and driven over lateral supporting elements 22 and 23 on which the yarns are distributed.

Said supporting side elements can for example be made up by belts provided with pins between which are distributed the weft yarns. Other types of side elements could also be used instead such as for example those commonly used to produce textile patterns and composed of helical elements.

The web of yarns being formed, it is possible, as illustrated in FIG. 4, to bring the longitudinal warp ends 25, either over one of its faces, or over its two faces. The yarns can then be for example adhesively bonded together, in the conventional way.

It would also be possible to use such a device to supply a knitting machine with cross wefts (Raschel or Malimo machines or the warp knitting machine, etc.).

The invention is in no way limited to the distribution of four feed yarns and on the contrary can be applied for distributing a much larger number of yarns, this being easily obtained by the fact that the rotating compartments are all identical and can therefore be in the form of individual modules adjoined one to the other in the required proportions.

What is claimed is:

1. A yarn creel device in combination with a means for producing a textile web characterized by yarns extending cross-wise with respect to the length of said web, said yarn creel device comprising:

means for storing yarn feed bobbins, characterized by a plurality of rotating compartments wherein the feed bobbins are fixedly mounted inside said compartments by means of supporting cradles mounted within said compartments for free rotation about the same axis of rotation as the compartments, said cradles being immobilized by the actual weight of the feed bobbins.

2. The yarn creel device as claimed in claim 1, wherein each said compartment is constituted by two lateral plates which are cross-shaped to give access to the inside, the space between said lateral plates being determined in relation to the space required for housing the yarn feed bobbin, and said lateral plates being interconnected by crosspieces designed to make the assembly rigid, and spaces being provided, on the one hand, between the outermost compartments and end plates of the yarn creel device, and, on the other hand, between two consecutive compartments, said spaces being defined by means of crosspieces, and the rigid assembly so constituted being mounted for rotation on a frame by means of shafts mounted on bearings on said frame, said assembly being driven in rotation by a motor.

3. The yarn creel device as claimed in claim 1, wherein the supporting cradles are mounted inside the compartments by means of bearings provided on the internal faces of the lateral plates, said bearings supporting a hollow axle holding said cradles in position.

* * * * *